US010944208B1

(12) United States Patent
Lamusga

(10) Patent No.: US 10,944,208 B1
(45) Date of Patent: Mar. 9, 2021

(54) ELECTRICAL EXTENSION CORD STAND AND ANCHOR APPARATUSES

(71) Applicant: Steven Lamusga, Antioch, IL (US)

(72) Inventor: Steven Lamusga, Antioch, IL (US)

( * ) Notice: Subject to any disclaimer, the term of this patent is extended or adjusted under 35 U.S.C. 154(b) by 0 days.

(21) Appl. No.: 16/403,063

(22) Filed: May 3, 2019

Related U.S. Application Data

(60) Provisional application No. 62/667,692, filed on May 7, 2018.

(51) Int. Cl.
*H01R 13/60* (2006.01)
*H01R 25/00* (2006.01)

(52) U.S. Cl.
CPC ..... *H01R 13/60* (2013.01); *H01R 25/003* (2013.01)

(58) Field of Classification Search
CPC ..... H01R 13/443; H01R 13/447; H01R 13/6392; H01R 13/639; H01R 13/60
USPC ..... 439/148
See application file for complete search history.

(56) References Cited

U.S. PATENT DOCUMENTS 2,721,717 A 5/1951 Wales
3,553,627 A 1/1971 Gerber
4,676,570 A * 6/1987 Pincherri ..... H01R 13/443 439/148
4,921,444 A 5/1990 Cama
5,080,599 A * 1/1992 Wimberly ..... H01R 13/443 174/67
5,096,430 A * 3/1992 D'Amico ..... H01R 13/443 174/67
5,238,416 A * 8/1993 Dickie ..... H01R 13/443 439/142
5,308,253 A * 5/1994 Maki ..... H01R 13/443 248/205.3
5,375,728 A * 12/1994 West ..... H01R 13/443 174/488
5,775,947 A 7/1998 McElhone
6,210,213 B1 4/2001 Stekelenburg
9,755,354 B1 9/2017 Aumiller

* cited by examiner

*Primary Examiner* — Hien D Vu
(74) *Attorney, Agent, or Firm* — Scherrer Patent & Trademark Law, P.C.; Stephen T. Scherrer; Monique A. Momeauit

(57) ABSTRACT

Electrical extension cord stand and anchor apparatuses provide a stand comprising a base having at least one set of prongs extending perpendicular from a surface of the base, wherein the base comprises means for holding the base onto a surface. The at least one set of prongs mates with a pair of slots in an electrical extension cord head having a plurality of pairs of slots therein for plugging electrical devices therein. Methods of making and using the same are further provided.

13 Claims, 4 Drawing Sheets

ELECTRICAL EXTENSION CORD STAND AND ANCHOR APPARATUSES

The present invention claims priority to U.S. Provisional Pat. App. No. 62/667,692, titled "Electrical Extension Cord Stand and Anchor Apparatuses," filed May 7, 2018, which is incorporated by reference herein in its entirety.

TECHNICAL FIELD

The present invention relates to electrical extension cord stand and anchor apparatuses. More specifically, the present invention provides a stand comprising a base having at least one set of prongs extending perpendicular from a surface of the base, wherein the base comprises means for holding the base onto a surface. The at least one set of prongs mates with a pair of slots in an electrical extension cord head having a plurality of pairs of slots therein for plugging electrical devices therein. Methods of making and using the same are further provided.

BACKGROUND OF THE INVENTION

Extension cords have been around since the dawn of electricity, and are well-known for providing means to plug electrical devices in locations set away from a wall receptacle or other immovable or otherwise unreachable electrical receptacle. Indeed, a generally standard electrical receptacle extension cord 10 is illustrated in FIG. 1, and comprises an extension cable 12 and a plug 14 on a first terminal end of the extension cable 12, wherein positioned on a second terminal end of the extension cable is a receptacle head 16 comprising a plurality of receptacle slot pairs 18 for plugging multiple electrical devices therein. In a standard extension cord, the head 16 comprises two slot pairs 18 on a first side of the head 16 and a single slot pair on the other side. However, other extension cords comprise more than the three slot pairs illustrated in FIG. 1, and any may be utilized in connection with the present invention. In general, the extension cord provides the means to extend electrical connection to areas previously unreachable, and also provides the advantage of plugging a plurality of electrical devices therein.

For example, a user may have a bedside table set a distance from a wall receptacle, and may wish to use the bedside table to power a bedside lamp, and his or her mobile phone, tablet computer, or any other like electrical device. An extension cord, as described above, may be utilized to accomplish providing electrical power to these devices. However, typical extension cord plugs generally are not anchored so oftentimes the extension cord head with the plurality of electrical receptacle slot pairs are difficult to reach, as the extension cord is often tucked back behind the table to remain unseen. Thus, a user must typically attempt to find the extension cord behind or under the table to plug or unplug an electrical device.

Moreover, a user may desire to simply place the extension cord head with the plurality of electrical receptacle slot pairs directly on the bedside table, thereby providing easy access thereto. Extension cords tend not to have any ability to anchor down to a surface, so the extension cord must often be weighted down with another object, or simply placed on the surface in the hopes that it will not move. However, as is often the case, simply bumping the table or moving the extension cord itself may cause it to jostle and/or fall from the table, making use difficult. In addition, extension cords often have a "shape memory" therein from being stored in a coiled configuration while in packaging, and this shape memory may cause the extension cord to retract while a user attempts to place it on the table for use, making it difficult to stay in one position and use when needed. Also, if the extension cord does not lay flat on the table, then it may be unsightly and make the table appear messy. FIG. 2 illustrates an extension cord 10 on an end of a table 20, showing how messy, unsightly and unstable it may be when simply placed on the table surface. Also, without being held to the table 20, the extension cord in FIG. 1 may simply fall from the table 20, making it difficult to retrieve and use when needed.

Heretofore, attempts to anchor electrical extension cords often utilize brads, staples, nails or other like connecting means to hold electrical cords in place. Of course, electricity can be very dangerous, and must be treated with caution. Using metal holding or attachment means around an electrical cord can cause the shielding to be punctured, thereby creating an unsafe condition, where a user may become shocked or electrocuted.

Moreover, other solutions include utilizing a shell to encase the electrical extension cord head and anchoring the shell to a surface. However, using a shell having a mating shape as the extension cord head itself limits the application of the anchor, in that only extension cords that fit the particular shell may be utilized, and if a different extension cord head size or shape is necessary, a completely different anchor shell must be used.

A need, therefore, exists for an electrical receptacle stand apparatus that may anchor an extension cord to a surface. Specifically, a need exists for an electrical receptacle stand apparatus that anchors an extension cord to a surface that provides a usable one or more electrical receptacle slot pairs on a surface for a user to utilize as needed.

Moreover, a need exists for an electrical receptacle stand apparatus that anchors an extension cord to a surface that may remain where a user intends to place it, without falling or otherwise moving from the surface it is placed on. Specifically, a need exists for an electrical receptacle stand apparatus that anchors an extension cord to a surface that may be easy to find and utilize as needed.

Further, a need exists for an electrical receptacle stand apparatus that anchors an extension cord to a surface that does not appear unsightly or messy, and holds the extension cord where desired without movement thereof due to jostling of the surface or shape memory of the extension cord.

Still further, a need exists for an electrical receptacle stand apparatus that anchors an extension cord to a surface that is safe to use, and does not pierce or otherwise puncture shielding, thereby ensuring that a user is not injured using the same.

Moreover, a need exists for an electrical extension cord stand and anchor apparatus that may be modular to accommodate different sizes and shapes of electrical extension cords.

SUMMARY OF THE INVENTION

The present invention relates to electrical extension cord stand and anchor apparatuses. More specifically, the present invention provides a stand comprising a base having at least one set of prongs extending perpendicular from a surface of the base, wherein the base comprises means for holding the base onto a surface. The at least one set of prongs mates with a pair of slots in an electrical extension cord head having a plurality of pairs of slots therein for plugging electrical devices therein. Methods of making and using the same are further provided.

To this end, in an embodiment of the present invention, an electrical extension cord stand and anchor apparatus is provided. The apparatus comprises a base having a top surface and a bottom surface; and a first set of prongs extending perpendicularly from the top surface and configured to engage a first set of slots in an extension cord to hold the extension cord thereon.

In an embodiment, the base is made from a weighted material configured to minimize movement of the same when placed on a surface.

In an embodiment, the electrical extension cord stand and anchor apparatus further comprises a second set of prongs extending perpendicularly from the top surface and configured to engage a second set of slots in the extension cord to hold the extension cord thereon.

In an embodiment, the first set of prongs and the second set of prongs are spaced apart from each other and are configured to mate with the first and second sets of slots within the extension cord.

In an embodiment, the first set of prongs extends from a first plate, wherein the first plate is attached to the base.

In an embodiment, the first plate is adhered to the base.

In an embodiment, the second set of prongs extends from the first plate.

In an embodiment, the electrical extension cord stand and anchor apparatus further comprises: an area of weakness on the first plate between the first set of prongs and the second set of prongs, wherein the first plate is configured to be separated at the area of weakness to separate the first set of prongs from the second set of prongs.

In an embodiment, the second set of prong extends from a second plate, wherein the second plate is attached to the base.

In an embodiment, the second plate is adhered to the base.

In an embodiment, the base comprises an internal space, wherein the internal space is configured to accept a weighted material.

In an embodiment, the electrical extension cord stand and anchor apparatus further comprises: a weighted material disposed within the space.

In an embodiment, the base is a shell having an open side and further comprises a removable cover covering the open side of the base.

In an embodiment, the electrical extension cord stand and anchor apparatus further comprises: a frictional material on the bottom surface of the base configured to frictionally hold the base to a surface.

In an embodiment, the electrical extension cord stand and anchor apparatus further comprises an adhesive on the bottom surface of the base, wherein the adhesive is configured to adhere the base to a surface.

In an embodiment, the electrical extension cord stand and anchor apparatus further comprise an extension cord having a first set of slots, wherein the first set of prongs is mated with the first set of slots in the extension cord.

In an alternate embodiment of the present invention, a method of holding an extension cord is provided. The method comprises the steps of: providing an electrical extension cord stand and anchor apparatus comprising a base having a top surface and a bottom surface, and a first set of prongs extending perpendicularly from the top surface and configured to engage a first set of slots in an extension cord to hold the extension cord thereon; providing an extension cord having a head having a first surface and a second surface, wherein the first surface comprises a first set of slots and the second comprises a second set of slots; and plugging the first set of prongs extending from the base into the first set of slots within the first surface, thereby holding the extension cord on the base.

In an embodiment, the method further comprises the step of: plugging an electrical device into the second set of slots within the second surface of the extension cord.

In an embodiment, first set of prongs extends from a first plate and further comprises the steps of: providing a second set of prongs extending from the first plate; and attaching the first plate to the base.

In an embodiment, the first set of prongs extends from a first plate and the method further comprises the steps of: providing a second set of prongs extending from the first plate, wherein the first plate comprises an area of weakness between the first set of prongs and the second set of prongs; separating the first set of prongs from the second set of prongs forming a first plate section having the first set of prongs extending therefrom and a second plate section having the second set of prongs extending therefrom; connecting the first plate section to the base; and connecting the second plate section to the base.

It is, therefore, an advantage and objective of the present invention to provide an electrical receptacle stand apparatus that may anchor an extension cord to a surface.

Specifically, it is an advantage and objective of the present invention to provide an electrical receptacle stand apparatus that anchors an extension cord to a surface that provides a usable one or more electrical receptacle slot pairs on a surface for a user to utilize as needed.

Moreover, it is an advantage and objective of the present invention to provide an electrical receptacle stand apparatus that anchors an extension cord to a surface that may remain where a user intends to place it, without falling or otherwise moving from the surface it is placed on.

Specifically, it is an advantage and objective of the present invention to provide an electrical receptacle stand apparatus that anchors an extension cord to a surface that may be easy to find and utilize as needed.

Further, it is an advantage and objective of the present invention to provide an electrical receptacle stand apparatus that anchors an extension cord to a surface that does not appear unsightly or messy, and holds the extension cord where desired without movement thereof due to jostling of the surface or shape memory of the extension cord.

Still further, it is an advantage and objective of the present invention to provide an electrical receptacle stand apparatus that anchors an extension cord to a surface that is safe to use, and does not pierce or otherwise puncture shielding, thereby ensuring that a user is not injured using the same.

Moreover, it is an advantage and objective of the present invention to provide an electrical extension cord stand and anchor apparatus that may be modular to accommodate different sizes and shapes of electrical extension cords.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to electrical extension cord stand and anchor apparatuses. More specifically, the present invention provides a stand comprising a base having at least one set of prongs extending perpendicular from a surface of the base, wherein the base comprises means for holding the base onto a surface. The at least one set of prongs mates with a pair of slots in an electrical extension cord head having a plurality of pairs of slots therein for plugging electrical devices therein. Methods of making and using the same are further provided.

Figure 1:
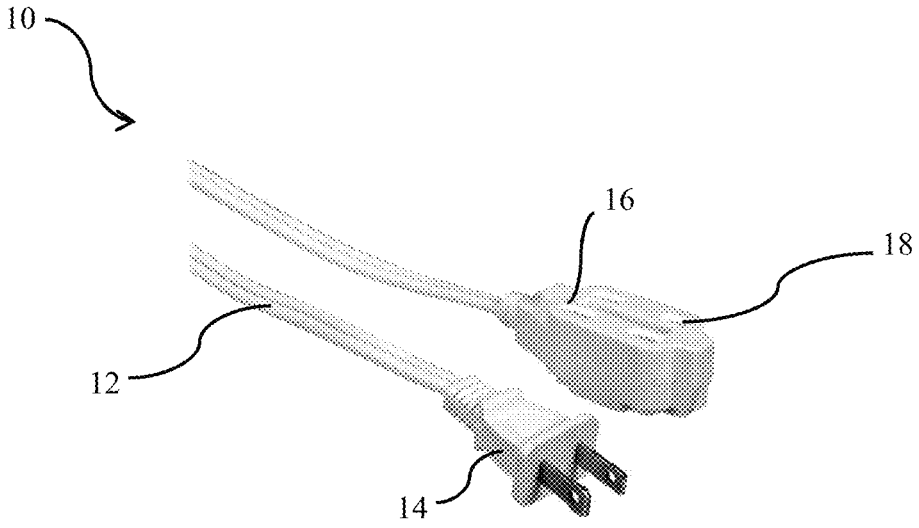
FIG. 1 (Prior Art)
FIG. 1 illustrates a prior art electrical extension cord.
Figure 2:
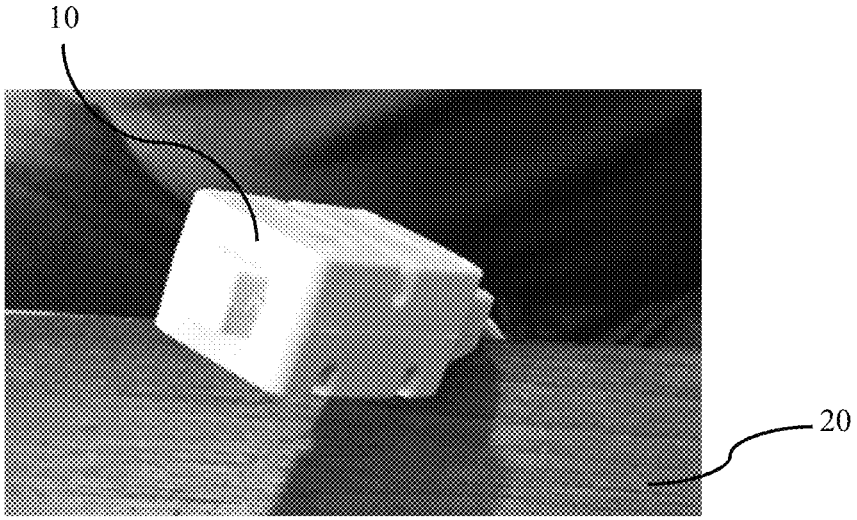
FIG. 2 (Prior Art)
FIG. 2 illustrates a prior art electrical extension cord placed on a table.
Figure 3:
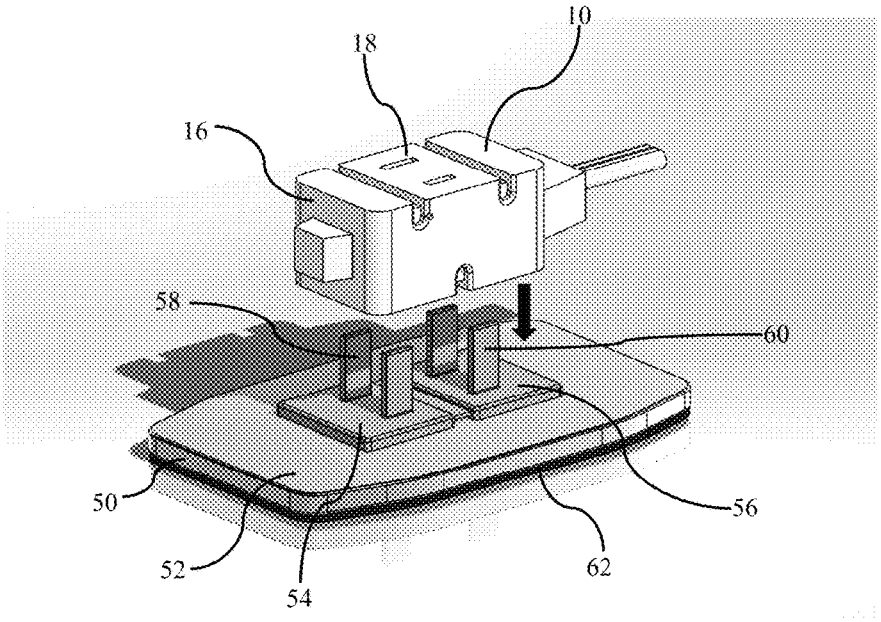
FIG. 3 illustrates a perspective view of an electrical extension cord stand and anchor apparatus in an embodiment of the present invention.

Now referring to the drawings, FIG. 3 illustrates and electrical extension cord stand and anchor apparatus 50 comprising a base 52 having a first plate 54 and a second plate 56 rigidly disposed on a top surface of the base 52. The first plate 54 comprises a first set of prongs 58 and the second plate 56 comprises a second set of prongs 60 (hereinafter, referred to as a "pair" of prongs, although any number of prongs may be included within each set, and the invention should not be limited as described herein), wherein each of the first and second pairs of prongs 58, 60 extend perpendicularly or roughly perpendicularly from the first and second plates 54, 56.

The first and second plates 54, 56 are rigidly held to the base 52 via any means apparent to one of ordinary skill in the art, including via an adhesive, by being bolted, welded, molded therewith, or any other means for holding the first and second plates 54, 56 to the base 52.

Figure 4:
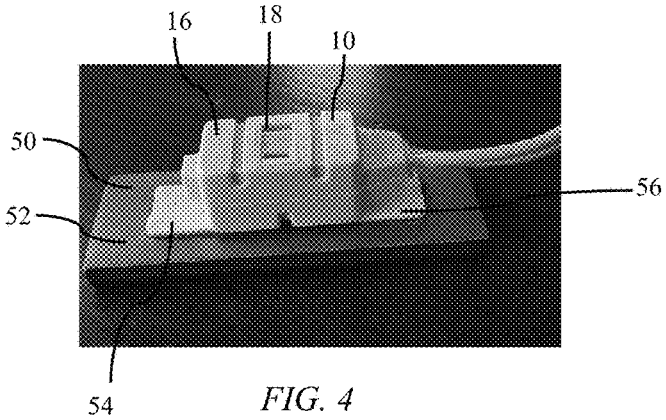
FIG. 4 illustrates a perspective view of an electrical extension cord stand and anchor apparatus having an extension cord disposed thereon in an embodiment of the present invention.
Figure 5:
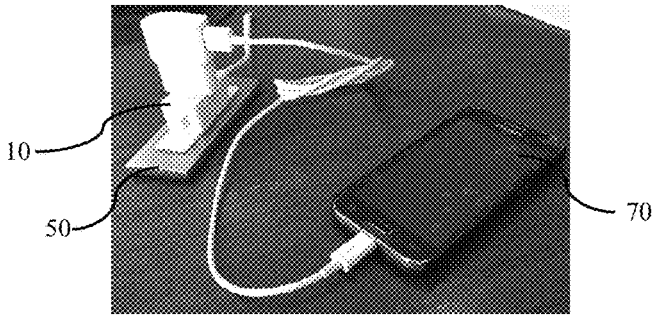
FIG. 5 illustrates a perspective view of an electrical extension cord stand and anchor apparatus having an extension cord disposed thereon and an electronic device plugged thereinto in an embodiment of the present invention.

The first and second pairs of prongs 58, 60 may be preferably made from a thermoplastic material, but may be made from any insulating material known to one of ordinary skill in the art. As illustrated in FIGS. 3 and 4, the head 16 of the extension cord 10 may be disposed on the first and second pairs of prongs 58, 60, wherein the first and second pairs of prongs 58, 60 are disposed within pairs of slots 18 on a side of the head 16 of the extension cord 10. The first and second pairs of prongs 58, 60 anchor and hold the extension cord 10 in position, such that at least one pair of slots 18 (as illustrated in FIG. 3) is exposed and available for plugging an electrical device thereto, as illustrated in FIG. 5.

As illustrated in FIG. 4, the head 16 of the extension cord 10 is fully disposed on the first and second pairs of prongs 58, 60 (not shown in FIG. 4), thereby anchoring the extension cord to the base 52. Moreover, FIG. 5 illustrates an electrical device, such as a mobile phone 70, that may be plugged into the extension cord 10 that is anchored to the apparatus 50 and utilized, thereby keeping the extension cord 10 on the table or other surface, unmoving and aesthetically pleasing.

The first and second pairs of prongs 58, 60 may be appropriately spaced from each other so that the pairs of slots in the head 16 of the extension cord 10 may align with the first and second pairs of prongs 58, 60. Moreover, the first and second pairs of prongs 58, 60 may have, on surfaces thereof, a texture, a prong, a frictional material, or other like element that aids in holding the first and/or second pairs of prongs 58, 60 within the respective pairs of slots 18 of the extension cord, as disclosed above.

In a preferred embodiment, the base 52 may have a pad 62 disposed on an underside thereof, as illustrated in FIG. 3. The pad 62 may be made from a material that prevents the base 52 from scratching the surface to which it rests upon. Specifically, the pad 62 may be foam, felt, or any other soft material apparent to one of ordinary skill in the art, and may be held thereon via adhesive or other like adherence. Additionally, the base 52 may comprise an elastomeric material that may restrict or minimize movement of the base 52 when disposed on surface based on friction. Alternatively, the base 52 may comprise an adhesive on an underside thereof, allowing the base to be adhered to a surface, preventing or minimizing movement thereof. The base 52 may also be held to a surface in any other manner apparatus to one of ordinary skill in the art, including magnets, adhesive tape, suction cups, bolts, screws, or any other means apparent to one of ordinary skill in the art, and the invention described herein should not be limited.

The base 52 may be made from a heavy metal, dense thermoplastic, or other material that allows the base 52 to rest upon a surface thereby minimizing movement thereof. Specifically, the weight of the base 52 may hold the extension cord 10 in place and minimize or prevent movement thereof.

Figure 6:
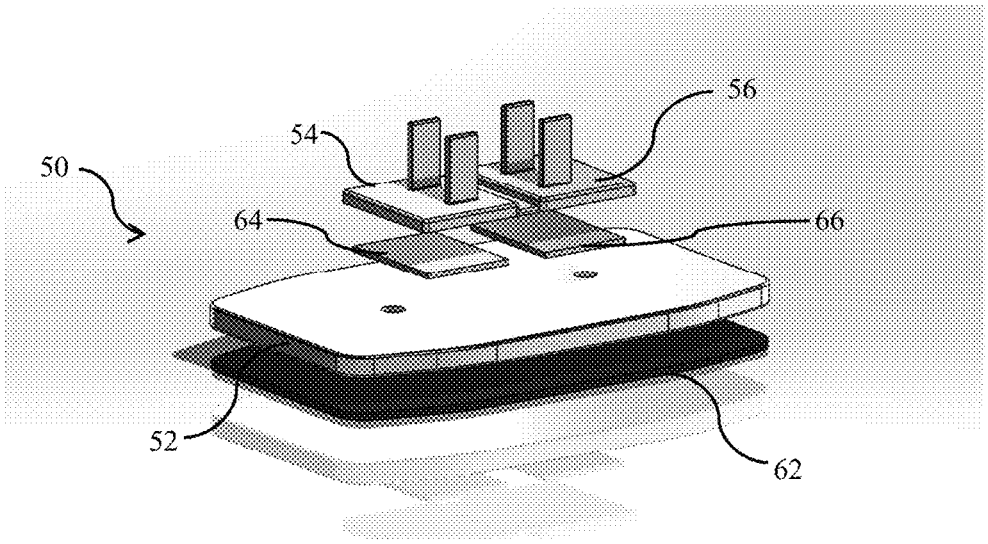
FIG. 6 illustrates an exploded view of an electrical extension cord stand and anchor apparatus in an embodiment of the present invention.

Referring now to FIG. 6, an exploded view of the apparatus 50 in an embodiment of the present invention is illustrated. The apparatus 50 may comprise the base 52, the pad 62, and the first plate 54 and the second plate 56 held to the base 52 via adhesive pads 64, 66.

Figure 7:
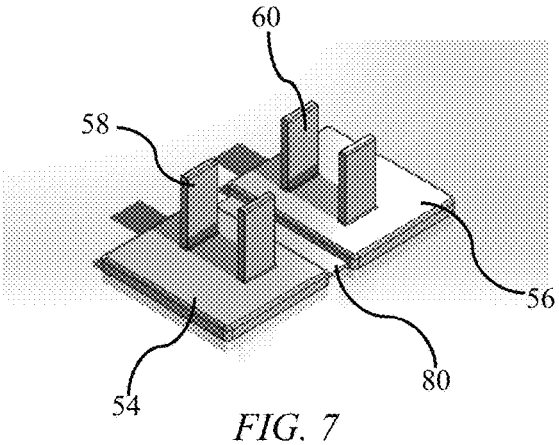
FIG. 7 illustrates a perspective view of first and second plates having first and second pairs of prongs, respectively, and a bridging member connecting the first and second plates in an embodiment of the present invention.

FIG. 7 illustrates first and second plates 54, 56 disposed together via a bridging member 80 disposed therebetween. The bridging member 80 may be comprised of a relatively thin material that may be easily cut, as described in more detail below.

Figure 8:
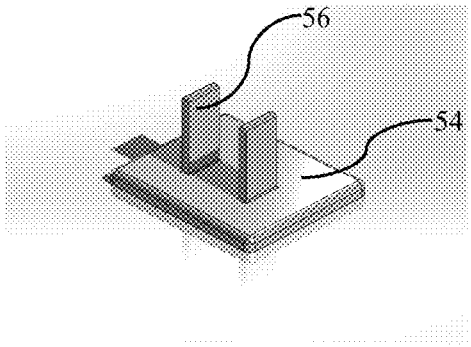
FIG. 8 illustrates a perspective view of a first plate having a first pair of prongs disposed thereon in an embodiment of the present invention.

In a preferred embodiment, the spacing of the first and second pairs of prongs 58, 60 may exactly match the first and second pairs of slots 58, 60 on the head 16 of an extension cord 10, and may thus allow the extension cord 10 to be placed directly thereon without manipulation or changing the same. In other embodiments, the spacing of first and second pairs of slots 18 on the head 16 of an extension cord 10 may not match directly with the spacing of the first and second prongs 58, 60 on the first and second plates 54, 56, as illustrated in FIG. 7. In such a situation, the bridging member 80 may be cut, such as with scissors, a blade or some other cutting tool, thereby separating the first and second plates 54, 56 from each other so that the same may be spaced appropriately. FIG. 8 illustrates first plate 54 with first pair of prongs 58 disposed thereon and separated from second plate 56.

By separating first and second plates 54, 56 from each other, the first and second pairs of prongs 58, 60 may be positioned as needed to fit any extension cord with at least two pairs of slots. As illustrated in FIG. 8, the first pair of prongs 58 may be offset from a side of the first plate 54, so that when turned around 180° may provide additional distance when positioned adjacent second plate 56. Likewise, second plate 56 may also be offset from a side of the second plate 56, so that when turned around 180° may provide even further additional distance when positioned adjacent first plate 54.

Figure 9:
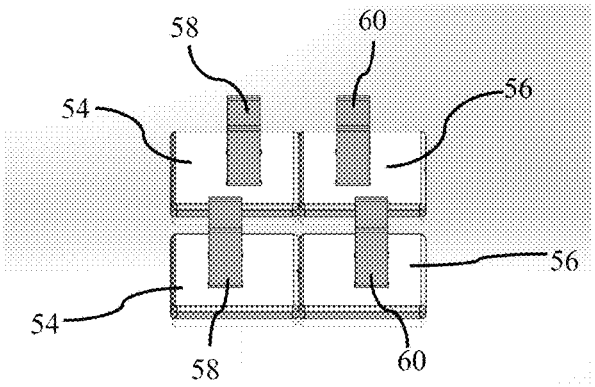
FIG. 9 illustrates a perspective view of two sets of first and second plates showing relative spacing of first and second pairs of prongs disposed thereon in an embodiment of the present invention.

FIG. 9 illustrates a side-by-side comparison of first and second plates 54, 56. In the upper image, first and second pairs of prongs 58, 60 are disposed relatively close to each other, compared to first and second plates 54, 56 (in the lower image) having first and second pairs of prongs 58, 60 disposed further apart from each other by turning the first and second plates 54, 56 around 180 degrees from each other. Thus, the first and second prongs 58, 60 may be more precisely positioned to mate with pairs of slots on an extension cord, as needed. In a preferred embodiment, first and second plates 54, 56, may be molded such that first and second pairs of prongs 58, 60 are positioned to fit into two pairs of adjacent slots on a standard ungrounded extension cord. However, standard grounded extended cords provide slightly larger space between adjacent pairs of slots to account for the space needed for the ground plug; therefore, the first and second plates 54, 56 may be cut and repositioned 180° relative to each other to provide proper spacing of the pairs of prongs 58, 60. Thus, by cutting the first and second plates 54, 56 apart from each other and repositioning the same, the proper positioning of first and second pairs of prongs 58, 60 may be easily achieved. These configurations may account for the vast majority of extension cords on the market. However, in the event that an extension cord has adjacent slots that are positioned another distance from each other, the plates 54, 56 may be cut away from each other, as described above, and positioned as needed.

More specifically, in a method of using the apparatus 50 of the present invention, first and second plates 54, 56 may be cut at bridging member 80 to separate the first and second plates 54, 56 from each other. Adhesive tape 64, 66 (as illustrated in FIG. 6) may be placed beneath the first and second plates 54, 56 to accommodate adhering the same to the base 52. Prior to adhering the first and second plates 54, 56 to the base 52, the first and second pairs of prongs 58, 60 may be separately mated with first and second pairs of slots in the head of the extension cord. The adhesive tape may then be exposed by removing any removable backing, and the adhesive tape 64, 66 disposed on the first and second plates 54, 56, respectively, may be pressed onto the base 52, thereby adhering the first and second plates 54, 56 to the base 52 in the proper position necessary to hold the extension cord head thereon.

Figure 10:
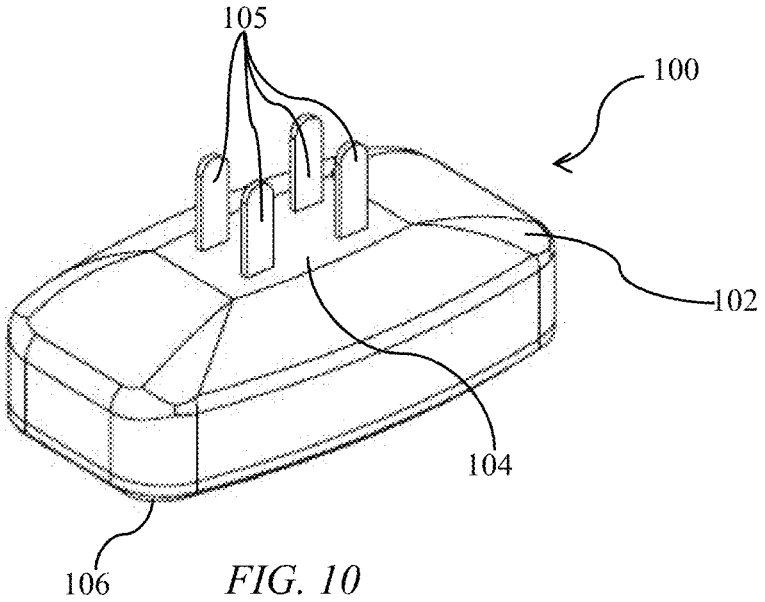
FIG. 10 illustrates a perspective view of an electrical cord stand and anchor apparatus in an embodiment of the present invention.
Figure 11:
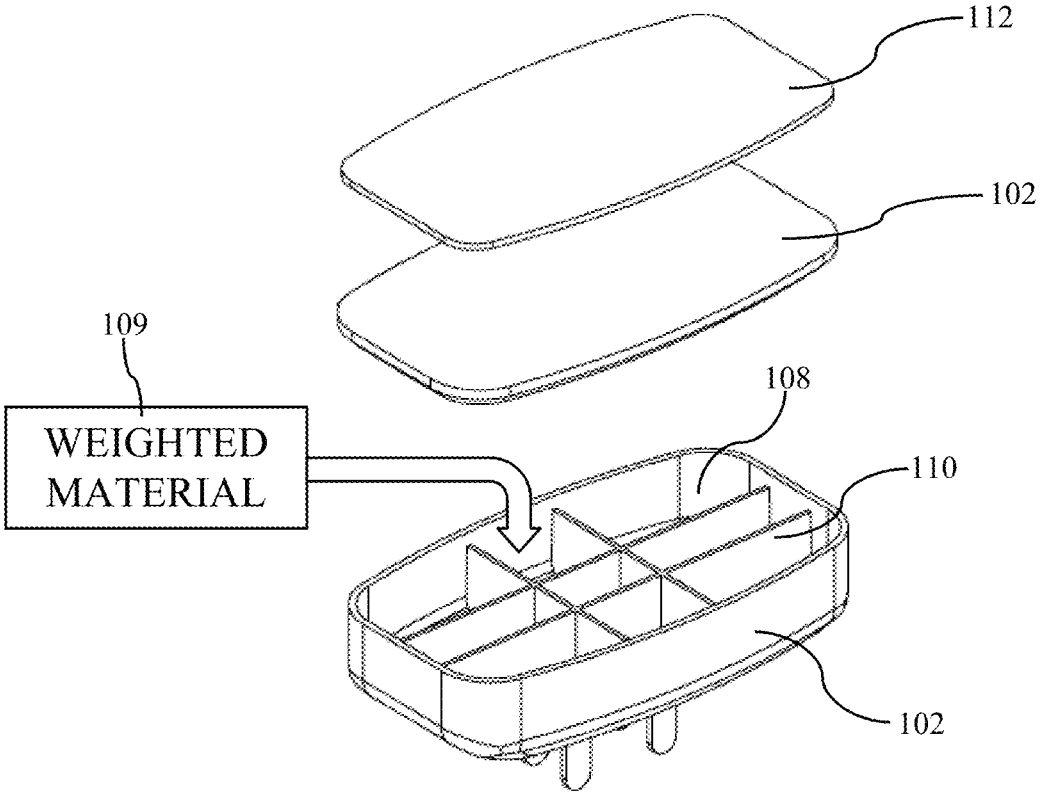
FIG. 11 illustrates an exploded backside view of an electrical cord stand and anchor apparatus in an embodiment of the present invention.

In an alternate embodiment, illustrated in FIGS. 10 and 11, an electrical extension cord stand and apparatus 100 is illustrated in a perspective view, illustrated in FIG. 10, and in an exploded backside view, as illustrated in FIG. 11. The apparatus 100 may comprise a base 102 having a top surface 104, having a plurality of prongs 105 for engaging with an extension cord, as described herein, and a bottom surface 106. The base 102 may be a shell having an interior space 108 that may be filled with weighted material 109 to weigh down the base. For example, the base 102 may be filled with sand, pellets, liquid, gel, or any other material that provides weight to the base so the base rests upon a surface and minimizes movement thereof.

As illustrated in FIG. 11, the base 102 may have support elements 110 disposed within the interior space 108 to fortify the base 102. The bottom surface 106 may be a removable cover that may be placed on the base 102 to maintain the weighted material therein, which may be compressed or frictionally held thereon, as apparent to one of ordinary skill in the art. A frictional material 112 may be disposed on the bottom surface 106 so that when the base 102 is placed on a table top or other surface, the base 102 may be prevented from moving, or may otherwise be frictionally held in place on the tabletop or other surface.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An electrical extension cord stand and anchor apparatus comprising:

a base having a bottom surface configured to contact a horizontal or a vertical surface, the base further having a top surface without any walls extending from the top surface; and at least a plate having a first set of prongs extending perpendicularly therefrom and being attached to the top surface and configured to engage a first set of slots in an extension cord to hold the extension cord thereon, wherein the base comprises a metal material or sand, the base configured to minimize movement of the base when placed on the horizontal or vertical surface.

2. The electrical extension cord stand and anchor apparatus of claim 1 further comprising:

a second set of prongs extending perpendicularly from the top surface and configured to engage a second set of slots in the extension cord to hold the extension cord thereon.

3. The electrical extension cord stand and anchor apparatus of claim 2 wherein the first set of prongs and the second set of prongs are spaced apart from each other and are configured to mate with the first and second sets of slots within the extension cord.

4. The electrical extension cord stand and anchor apparatus of claim 1 wherein the first plate is adhered to the base.

5. The electrical extension cord stand and anchor apparatus of claim 1 wherein a second set of prongs extends from the first plate.

6. The electrical extension cord stand and anchor apparatus of claim 5 further comprising:

an area of weakness on the first plate between the first set of prongs and the second set of prongs, wherein the first plate is configured to be separated at the area of weakness to separate the first set of prongs from the second set of prongs.

7. The electrical extension cord stand and anchor apparatus of claim 1 wherein the second plate is adhered to the base.

8. The electrical extension cord stand and anchor apparatus of claim 1 wherein the base comprises an internal space, wherein the internal space is configured to accept a weighted material.

9. The electrical extension cord stand and anchor apparatus of claim 8 further comprising:

a weighted material disposed within the space.

10. The electrical extension cord stand and anchor apparatus of claim 8 wherein the base is a shell having an open side and further comprising:

a removable cover covering the open side of the base.

11. The electrical extension cord stand and anchor apparatus of claim 1 further comprising:

an elastomeric material on the bottom surface of the base configured to frictionally hold the base to a surface.

12. The electrical extension cord stand and anchor apparatus of claim 1 further comprising:

an adhesive on the bottom surface of the base, wherein the adhesive is configured to adhere the base to a surface.

13. The electrical extension cord stand and anchor apparatus of claim 1 further comprising:

an extension cord having a first set of slots, wherein the first set of prongs is mated with the first set of slots in the extension cord.

* * * * *